US008432241B2

(12) United States Patent
Schneider et al.

(10) Patent No.: US 8,432,241 B2
(45) Date of Patent: Apr. 30, 2013

(54) CONTACT ARRANGEMENT HAVING A BENT CORD, RELAY HAVING A CONTACT ARRANGEMENT AND METHOD FOR ASSEMBLING A RELAY

(75) Inventors: Axel Schneider, Berlin (DE); Thomas Haehnel, Berlin (DE); Christian Maranke, Luechfeld (DE); Joerg Schultheiss, Nuthetal (DE); Albert Koetter, Berlin (DE)

(73) Assignee: Tyco Electronics AMP GmbH, Bensheim (DE)

( * ) Notice: Subject to any disclaimer, the term of this patent is extended or adjusted under 35 U.S.C. 154(b) by 7 days.

(21) Appl. No.: 13/061,100

(22) PCT Filed: Jul. 24, 2009

(86) PCT No.: PCT/EP2009/059561

§ 371 (c)(1),
(2), (4) Date: Jun. 17, 2011

(87) PCT Pub. No.: WO2010/023045

PCT Pub. Date: Mar. 4, 2010

(65) Prior Publication Data

US 2011/0234340 A1 Sep. 29, 2011

(30) Foreign Application Priority Data

Aug. 26, 2008 (DE) ..... 10 2008 039 704

(51) Int. Cl.
*H01H 51/22* (2006.01)

(52) U.S. Cl.
USPC ..... 335/83; 335/78; 335/128

(58) Field of Classification Search ..... 335/78–86, 335/128
See application file for complete search history.

(56) References Cited

U.S. PATENT DOCUMENTS

| | | | | |
|---|---|---|---|---|
| 4,647,743 | A | 3/1987 | Kern et al. | |
| 4,837,538 | A | 6/1989 | Dittmann | |
| 4,924,197 | A * | 5/1990 | Siepmann | 335/128 |
| 5,324,901 | A | 6/1994 | Hendel et al. | |
| 5,534,834 | A * | 7/1996 | Hendel | 335/78 |
| 5,587,693 | A | 12/1996 | Fear | |
| 5,805,039 | A * | 9/1998 | Smith | 335/78 |
| 5,886,601 | A * | 3/1999 | Kitamura et al. | 335/129 |
| 6,958,671 | B2 * | 10/2005 | Chen et al. | 335/80 |

FOREIGN PATENT DOCUMENTS

| | | |
|---|---|---|
| DE | 195 22 931 A1 | 1/1997 |
| EP | 0 281 950 A | 9/1988 |

OTHER PUBLICATIONS

International Search Report issued by the European Patent Office for PCT/EP2009/060546 on Oct. 21, 2009.

* cited by examiner

*Primary Examiner* — Bernard Rojas
(74) *Attorney, Agent, or Firm* — Faegre Baker Daniels LLP

(57) ABSTRACT

The present invention relates to a contact arrangement for a relay for switching high load currents. Furthermore, the invention relates to a relay for switching high load currents having a contact arrangement. Finally, the invention relates to a method for assembling a relay. In order to be able to assemble the contact arrangement in the relay in an at least partially automated manner, without additional retention devices being required for a cord, there is provision according to theinvention for the cord to be retained in an inherently stable manner owning to its shape as a self-supporting structure and for the method to have a method step in which the cord is shaped to form a self-supporting structure with a bent shape.

13 Claims, 4 Drawing Sheets

CONTACT ARRANGEMENT HAVING A BENT CORD, RELAY HAVING A CONTACT ARRANGEMENT AND METHOD FOR ASSEMBLING A RELAY

The invention relates to a contact arrangement for a relay for switching high load currents, having at least one connection region, at least one switching contact which can be moved relative to the connection region in a switching direction and a flexible cord which has a bent shape and which connects the at least one connection region to the at least one switching contact so as to conduct load current. Furthermore, the invention relates to a relay for switching high load currents. Finally, the invention relates to a method for assembling a relay for switching high load currents having at least one connection region and at least one switching contact, in which a cord is at least formed with the at least one connection region and is connected to the at least one switching contact so as to conduct load current.

Contact arrangements for relays for switching high load currents and relays for switching high load currents having the contact arrangement mentioned above are widely available. Generally, the relay is provided with an actuator which converts control signals into movements. The actuator may be constructed in the form of a coil which, depending on electrical control signals, generates a magnetic field which can act in an attractive or repellent manner on an armature of the relay. The armature which is consequently moved in accordance with the control signals is connected to the switching contact so as to transmit movement and can move the switching contact in a switching direction at least from a first position into a second position. In the first or second position, the switching contact may be in contact with a fixed contact so as to conduct load current. In many relays, the switching contact remains in an idle position in the first or the second position if there is no corresponding control signal at the actuator. For example, the idle position of the switching contact is predetermined by means of an armature spring which is integrated in the relay in a pretensioned manner and retains the switching contact in the first or the second position, if there is no control signal. However, if there are corresponding control signals at the actuator, the switching contact is moved counter to the effective resilient force of the armature spring into the other position in each case. Without any corresponding control signals, the switching contact can return to the initial position again in accordance with the resilient force.

In particular when high load currents, for example, of more than 30 A are intended to be switched, lines with a large cross-section are required which direct the high load current from the fixed contact to the switching contact. In the case of current relays, so-called cords, that is to say, braids comprising a plurality of thin wires, are used as a line between a fixed connection of the relay connected to the connection region and the switching contact. These cords are flexible and consequently do not significantly inhibit the movement of the switching contact with respect to the connection region.

If the cord extends in a curved manner, at the most only small forces produced by the cord counteract the movement of the switching contact. However, a relay having such a cord cannot readily be assembled in an automated manner owing to the flexibility of the cord since the connection region of the cord cannot be positioned and connected to the fixed connection of the relay without manual intervention.

The object of the present invention is therefore to provide a contact arrangement for a relay, a relay and a method for assembling a relay, wherein the relay can be assembled with a high degree of automation.

The object is achieved according to the invention for the contact arrangement mentioned in the introduction in that the cord is retained in an inherently stable manner because it is formed as a self-supporting structure. For the relay mentioned in the introduction, the object is achieved according to the invention in that the relay comprises a contact arrangement according to the invention. Finally, the object is achieved for the method in that the cord is bent to form a self-supporting structure.

Owing to the self-supporting structure of the cord, the contact arrangement can be positioned in the relay as an integrally manageable and self-supporting assembly in such a manner that it assumes a predetermined position at least with respect to the fixed connection and retains it in a self-supporting manner. A separate retention of the cord with respect to its positioning relative to the fixed connection of the relay, which may optionally be carried out manually, is not necessary.

The solution according to the invention can be further improved by means of various configurations which are each advantageous and can be combined with each other as desired. These configurations and the advantages which are connected therewith are set out below.

According to a first configuration, the cord can produce a restoring force which acts counter to the bending action and the cord may be resiliently pretensioned. In particular, the cord may be bent in a curved manner only in one direction. The restoring force may form the cord in an inherently stable manner, be dependent on the radius of curvature of the cord and become greater as the radii of curvature become smaller. In particular in the regions of the cord which are bent in a curved manner, the resilient pretensioning may be produced by the cord itself. In particular when the cord has a substantially circular cross-section, the cord can retain its shape in a self-supporting manner even in the case of loads acting in different directions. A substantially circular cross-section is particularly advantageous for this purpose.

The cord can be secured to the at least one switching contact in a bent manner, counter to the restoring force it produces. Consequently, the restoring force can be absorbed at least by the at least one switching contact so that the cord is received and retained in the contact assembly in a resiliently pretensioned manner.

The cord can have two ends and can form an indentation or loop which is directed away from the ends thereof and which expands. Owing to the clearly non-angular and in particular at least partially bent shape, the shape of the indentation or loop distributes the restoring forces in a uniform manner on the cord and allows the cord to be inherently stable.

In the case of a cord which is bent in a loop-like manner, the two ends thereof may be close together. If the cord is bent in the form of an indentation, the ends of the cord may be arranged so as to be mutually spaced-apart. With both loop-like and indentation-like configurations of the cord, the ends of the cord may extend parallel and in the same direction or in opposing directions. In particular, the ends of the cord which is shaped in an indentation-like or loop-like manner may also be arranged in a non-parallel manner and may possibly be arranged in a substantially V-like manner. The ends may be next to each other or spaced-apart in the region of the tip of the V-shape.

In order to be able to produce the contact arrangement as a self-supporting assembly, the ends of the cord can be connected to the at least one switching contact which is provided in the contact arrangement. The switching contact, in particular in directions which are not the switching direction, can be integrated in a substantially non-displaceable manner in the contact arrangement. The restoring force can be directed substantially perpendicularly relative to the switching direction and the at least one switching contact can be arranged in the contact arrangement so as to act counter to the restoring or tensile force of the cord. The cord, between the ends or the regions via which the cord transmits the tensile force to the remainder of the contact arrangement, may extend at least partially in one direction so as to be bent in a curved manner. The cord can consequently have the curved shape and can be retained in an inherently stable manner as a self-supporting structure, without being connected to the fixed connection of the relay.

The connection region may be connected to the fixed connection so as to conduct load current only when the contact arrangement is mounted in a relay. The cord which is constructed in a loop-like or indentation-like manner can consequently have the shape which forms the self-supporting structure, even when the contact arrangement is not yet assembled in the relay.

The connection region of the cord may be arranged substantially centrally between the ends of the cord and may be configured for connection to a fixed connection of the relay. The cord can thus be connected securely to the fixed connection of the relay directly without having to connect additional components to the cord. Furthermore, the two cord portions which extend between the connection region and the at least one switching contact are of equal length and consequently have substantially the same level of electrical resistance.

The connection region can be constructed as a rigid member portion of the cord. A connection region which is constructed with a rigid member has, for example, the advantage that it can be better adapted to the geometry of the fixed connection than the unshaped cord alone, whereby a connection with improved electrical conductivity can be produced between the connection region and fixed connection.

The connection region may extend in a portion of the bent cord which is at a maximum distance from the at least one switching contact. This affords the advantage that the switching contacts can be more readily moved relative to the connection region and the connection region is more readily accessible for tools.

In the region of the ends thereof, the cord can be bent differently and in particular in an opposite direction to the remainder of the cord. In particular with the indentation-like configuration, the ends of the cord can be connected to two switching contacts and, for example, be guided around two retaining pins, which have a smaller distance relative to each other than the two switching contacts, which produces an even greater restoring force.

In the region of the at least one connection region and/or in the region of the at least one switching contact, the cord may extend substantially in a linear manner and the linear portions of the cord can be connected by means of bent intermediate portions. In particular a linear path of the cord in the region of the switching contacts allows a well-defined orientation of the cord. The linear path in the region of the connection region limits the height thereof in a vertical direction. In the case of a cord with regions which are constructed in a linear and inherently stable manner, in particular the bent intermediate portions of the cord or the cord curves can produce the restoring force and yield to the relative movement between the at least one connection region and the at least one fixed contact.

So that the cord is inherently stable in the linearly extending portions, the cord may also be partially constructed as a rigid member in the region of the at least one switching contact.

In order to partially reshape the cord into a rigid member, the cord can be heated, for example, using high electrical currents which are directed through at least a portion of the cord, and compressed during or even after a heating phase. The individual fibres of the cord can thereby be connected to each other in a materially integral manner so that the flexibility of the cord is reduced here and the cord becomes at least partially rigid. Owing to the reshaping, the rigid member portions can be constructed in such a manner that they can be positioned to be substantially flat on connection elements, such as the fixed connection, and can consequently be welded thereto in an effective manner.

In particular the connection region may, as a rigid member, have a face which is directed away from the contact arrangement and which can be constructed as a connection face for connection to the fixed connection of the relay so as to conduct load current. The rigid members at the ends of the cord may be constructed as a contact piece which is directed away from the cord end and via which the cords or the cord ends can be connected to the switching contact so as to conduct load current.

The cord ends and the switching contacts can be connected to each other so as to conduct load current by means of a connection piece in each case. The connection piece may have a contact portion which is securely connected to the respective switching contact and may, for example, be welded or riveted thereto. Furthermore, the connection piece may have a connection strap which may extend in an inclined manner relative to the contact portion and substantially away from the switching contact. In particular, the connection straps of two connection pieces may be directed away from each other and parallel with the path of the cord ends which are connected thereto. The angle between the connection strap and the contact portion may predetermine the angle of inclination at which the bent cord is directed away from the armature in the direction of the switching direction. Alternatively, the connection piece may be formed with two connection straps and may be substantially Y-shaped.

Owing to the different orientation of the connection strap and the contact portion, the connection pieces between the connection strap and the contact portion may be formed with a bent edge. The bent edges of two connection pieces may extend in a minor-symmetrical manner and/or in particular in mutual alignment and parallel with one of the straight lines connecting the switching contacts.

Furthermore, the contact arrangement may have an armature and an armature spring which forms an angle and which has at least one abutment member and at least one switch member, the at least one switch member being able to be secured to the armature and to connect the armature to the at least one switching contact so as to transmit movement. The assembly of this contact arrangement can be carried out more readily outside the relay since the armature, the armature spring and the switching contact can in each case be connected to each other in a non-displaceable manner and, for example, riveted, without other components of the relay impeding this.

The at least one switching contact can be connected to the armature by means of a portion of the armature spring that forms an overtravel spring. The armature spring, between the region in which the switch member of the armature spring is connected to the armature and the switching contact, can be formed in a substantially linear, web-like manner as a single-sided fixed bending beam, to the free end of which facing away from the contact arrangement the switching contact can be secured so as to be able to be resiliently deflected in the switching direction. Owing to this resilient suspension of the switching contact, damage to the switching contact by switching operations can at least be reduced since the switching contact does not strike in a restricted guided manner, a counter switching contact during a switching operation. If the spacing of the switching contact and counter switching contact in the non-connected state does not, for example, comply with a provision, this dimensional discrepancy can be absorbed by the resilient suspension of the switching contact. In addition, owing to the resiliently deflectable arrangement of the switching contact, so-called rebounding can at least be reduced. Finally, the use of overtravel springs allows automatic monitoring of the switching contacts if the distance measured between the switching contacts and the fixed contacts in the switching direction should increase, for example, owing to erosion of the contacts.

If there is a plurality of switching contacts, they may be connected to a common or in each case separate overtravel spring. Between the switching contacts and the overtravel spring, the contact portion of the connection piece may be arranged and connected to the switching contact and the overtravel spring in a non-displaceable manner.

The cord plane in which the cord extends may be inclined relative to the armature. Owing to the inclination of the cord plane, in particular in the switching direction with respect to the armature, the connection region is spaced apart from the remainder of the contact arrangement and can consequently be readily accessible for connection tools. Furthermore, the cord length measured parallel to the cord plane from the at least one switching contact to the connection region may be greater than with a cord which is not tilted, without the cord protruding in a vertical direction over the remainder of the contact arrangement. Consequently, the connection region may be constructed so as to be larger and assembled with a higher level of automation. Furthermore, the connection face of the connection region may extend parallel to the cord plane which further simplifies the assembly.

The contact arrangement may form an uninterrupted tool channel which may extend at both sides of the connection region substantially perpendicularly relative to the connection face of the connection region or the cord plane and may comprise a recess which is formed by the contact spring. The recess may, for example, be arranged in a connection region of the armature spring which is located between the abutment member and the switch member, the connection region being able to connect the abutment member and the switch member together so as to transmit resilient force. In the path thereof which extends in a transverse direction perpendicularly relative to the switching direction and the vertical direction, the connection region may be interrupted by the recess and the recess may extend both in the direction of the abutment member and in the direction of the switch member. The connection region can form the angle of the armature spring at both sides of the recess and transmit the resilient force.

The armature may have a clearance for the connection region so that the armature spring does not protrude beyond the armature in the vertical direction. At each of the two sides of the clearance of the armature, the sides of the armature may have a retention groove which is open in the transverse direction and by means of which the armature can be positioned in the relay.

Owing to the inclined orientation of the cord, the tool channel may extend in particular in an inclined manner relative to the switching direction and substantially diagonally relative to the contact arrangement. The tool channel may extend at least partially through the recess of the armature spring and through the clearance of the armature. Consequently, the tool channel provides sufficient space for connection tools to connect the connection region of the cord to the fixed connection of the relay, even when the contact arrangement is inserted in the relay.

If the contact arrangement has two switching contacts, they may be arranged at a mutual spacing in the transverse direction. The side of the cord plane, which is substantially trapezoidal in this case, located between the switching contacts is thereby widened, whereby the inherent stability of the cord can be further improved. Each of the switching contacts can be connected to a separate overtravel spring or a plurality of switching contacts can be connected to a common overtravel spring. Some or all of the switching contacts can be configured with more than one surface or switch surface which is orientated substantially perpendicularly relative to the switching direction. The switch surfaces can be arranged on both sides of the connection piece and in particular each of the switching contacts can be constructed as a changeover contact.

If the contact arrangement is inserted in the relay in an operating position, the fixed connection which is intended to be securely connected to the connection face of the connection region may protrude into the tool channel. The relay with the contact arrangement described above can therefore be more readily assembled since the contact arrangement can be inserted into the relay as a substantially self-supporting assembly. In particular after the armature has been positioned in the relay via the retention grooves and retained by means of retention webs which engage in the retention grooves, the contact arrangement can be positioned in the relay in an operating position. The cord and/or armature spring may be at least slightly deflected and connect the retention grooves to the retention webs in a non-positive-locking manner.

Now the connection region can be automatically pre-positioned relative to the fixed connection owing to the self-supporting structure of the cord and the connection region and the fixed connection can be readily accessible for connection tools, without the cord requiring another retaining member. A particularly secure connection between the connection region and the fixed connection is produced when the connection tools are constructed as welding electrodes and the connection region is welded to the fixed connection. For welding, a first welding electrode can be at least partially guided through the portion of the tool channel that extends through the clearance and the recess at a side of the connection region facing away from the fixed connection and a second welding electrode can be guided at a side of the fixed connection facing away from the connection region, the welding electrodes being able to be formed in a simple and linear manner or in a pincer-like manner.

The connection of the connection region and fixed connection can be carried out as a final operating step when the contact assembly is assembled in the relay.

The armature can be at least partially movably retained by means of the retention webs of the relay and moved in accordance with the control signals and in particular tilted or pivoted about a switch axis which connects the retention grooves.

The abutment member of the armature spring may be in resiliently deflected abutment against a stop which is orientated substantially parallel to the switching direction, the stop being able to be, for example, an integral component of an L-shaped yoke for receiving and retaining the coil. At least the side of the yoke that extends substantially perpendicularly to the switching direction can retain the coil at the end thereof facing away from the armature.

The resilient deflection of the abutment member produces the resilient force which can be transmitted to the switch member via the connection region of the armature spring. The switch member which is connected to the armature so as to transmit movement can transmit the resilient force into the armature which is consequently deflected and in particular tilted into a pre-defined idle position. The position of the armature can be changed in accordance with the control signals. Part of the resilient force can move the armature in such a manner that it can be connected to the yoke in a non-positive-locking manner by means of the retention grooves. The abutment member may be positioned displaceably on the stop or may be connected thereto in a non-displaceable manner.

If the abutment member is secured to the stop and, for example, welded thereto, the abutment member can be retained during the welding operation by means of a tensile force which is directed away from the connection region of the armature spring. The tensile force may be variable by means of the force with which the switching contacts are retained in the idle position thereof by the armature spring.

The relay may comprise the fixed connection which, after the contact arrangement has been assembled in the relay, may protrude into the tool channel and can be connected to the connection face of the connection region.

The invention is explained below by way of example with reference to embodiments and with reference to the drawings. The different features of the embodiments may be combined independently of each other, as already set out in the individual advantageous embodiments.

Figure 1:
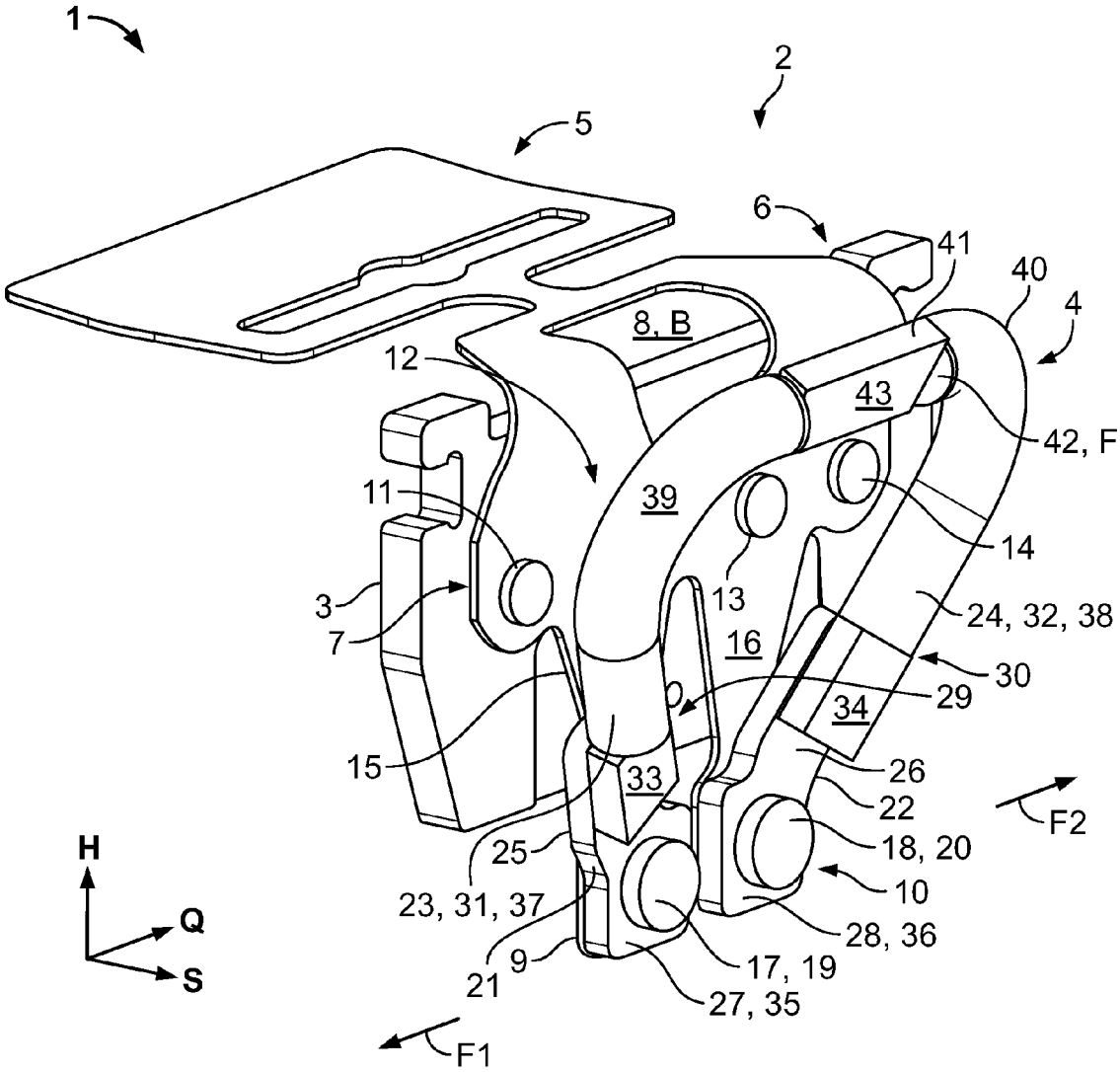
FIG. 1 is a perspective view of a first embodiment of the contact arrangement according to the invention.

Firstly, the construction and function of a contact arrangement according to the invention are described with reference to the embodiment of FIG. 1. In this instance, the contact arrangement 1 according to the invention having an armature spring 2, an armature 3 and a cord 4 is schematically illustrated. The armature spring 2 comprises an abutment member 5 and a switch member 7 which is connected to the abutment member 5 by means of a bent connection region 6. The abutment member 5 is illustrated so as to be orientated parallel to a switching direction S. Orientated substantially perpendicularly relative to the abutment member 5, the switch member 7 extends parallel to a vertical direction H. The connection region 6 has, in the path thereof which extends parallel to a transverse direction Q, a recess 8 which extends at least partially in the direction of the abutment member 5 and in the direction of the switch member 7. The end of the armature 3 directed in the vertical direction H has, in the path thereof directed in the transverse direction Q, a clearance 9 for the armature spring 2 and in particular the connection region 6 thereof which protrudes into the clearance 9.

The switch member 7 has free ends 10, 11 which are directed counter to the vertical direction H and between which and the connection region 6 there are provided four connection points 12 to 15 which are arranged substantially along the transverse direction Q. Via the connection points 12 to 15, the switch member 7 is riveted to the armature 3. Between the connection points 12 to 15 and the free ends 10, 11 of the switch member 7, the armature spring 2 is constructed with two web-like overtravel springs 16, 17. The web-like overtravel springs 16, 17 extend substantially counter to the vertical direction H, the free ends 10, 11 thereof being able to be resiliently deflected in the switching direction S.

Two switching contacts 18, 19 are secured to the free ends 10, 11, at least the surfaces 20, 21 of the switching contacts 18, 19 that are directed in the switching direction S being constructed so as to conduct load current and to withstand high switching currents. The switching contacts 18, 19 are in this instance constructed in a substantially circular-cylindrical manner. However, the shape of the switching contacts 18, 19 may also be different from the circular-cylindrical form and in particular the surfaces 20, 21 of the switching contacts 18, 19 directed in the switching direction may also extend in a curved manner. The switching contacts 18, 19 may in particular be formed as a connection rivet and may be riveted to the switch member 7 of the armature spring 2. Between the switching contacts 18, 19 and the ends 10, 11 of the overtravel springs 16, 17, connection pieces 22, 23 are arranged. The connection pieces 22, 23 connect the switching contacts 18, 19 to ends 24, 25 of the cord 4 which are directed substantially counter to the vertical direction H so as to conduct load current. The connection pieces 22, 23 have in particular a connection strap 26, 27 which is secured in each case to the cord 4 so as to conduct load current and a contact portion 28, 29 which contacts directly with one of the switching contacts 18, 19 so as to conduct load current. The connection straps 26, 27 which are directed substantially in the vertical direction H are directed at least partially away from each other and are inclined away from the switch member 7 and from the armature 3, respectively.

The ends 24, 25 of the cord 4 are at least partially constructed as rigid members 30, 31 and are connected to the connection straps 26, 27 of the connection pieces 22, 23. The rigid members 30, 31 are in abutment against faces 32, 33 of the connection strap 26, 27 facing away from the armature 3 and are secured thereto so as to conduct load current. For example, the rigid members 30, 31 can be welded to the faces 32, 33.

The cord ends 24, 25, in particular in the region of the rigid members 30, 31, are formed in a substantially linear and rigid manner.

Owing to the predetermined orientation of the rigid members 30, 31 which is substantially in alignment with the connection straps 26, 27, the cord 4 becomes deformed in the manner of an indentation. If the rigid members 30, 31 extend not so as to be directed away from each other, but instead parallel and in particular so as to be directed in the same direction, the cord 4 can be bent in the manner of a loop and the loop can expand, in the same manner as the indentation, away from the ends 24, 25 of the cord 4. In the region of the rigid members 30, 31, the cord ends 24, 25 have a predetermined minimum mutual spacing. In the path thereof extending in the vertical direction H, the distance between lateral portions 34, 35 of the bent cord 4 increases and reaches a maximum value in the vertical direction H in the vicinity of the connection region 6. In the vertical direction H above the rigid members 30, 31, the cord 4 extends at least partially in a curved manner and has cord curves 36, 37 which are formed as bent intermediate portions and which extend towards each other in a curved manner.

Between the cord curves 36, 37, the cord 4 is constructed as a connection region 38. The connection region 38 is constructed so as to conduct load current and at least partially as a rigid member 39 which extends between the cord curves 36, 37. In the region of the rigid member 39, the cord 4 also extends substantially in a linear manner. The width, extending in the transverse direction Q, of the rigid member 39 substantially corresponds to the expansion of the recess 8 which extends parallel to the transverse direction Q.

With respect to the switch member 7 and the armature 3, the cord 4 is orientated so as to be at least partially inclined in the switching direction S and defines a cord plane L. Faces of the rigid member 39 which are directed in and counter to the switching direction S are constructed in this instance substantially in a planar manner and extend parallel with the cord plane L. In particular, the face of the rigid member 39 facing away from the contact arrangement 1 in the switching direction S is constructed as a connection face 40 for connecting the connection region 38 to a fixed connection of a relay so as to conduct load current.

The cord curves 36, 37 are substantially bent counter to a resilient force which is produced by the cord 4 and which is absorbed by the rigid members 30, 31 of the cord ends 24, 25 and the rigid member 39 of the connection region 38. The resilient force is directed into the connection pieces 22, 23 in particular by the rigid members 30, 31 of the cord ends 24, 25, the resilient forces F1, F2 acting in the connection pieces 22, 23 extending parallel to the transverse direction Q and away from each other. Equal and opposing retention forces which are produced by the switch member 7 act counter to the resilient forces F1, F2.

The resilient forces F1, F2 which are produced in the cord curves 36, 37 owing to the bent shape of the cord 4 form the cord 4 into a self-supporting structure which retains the cord 4 in an inherently stable manner.

Figure 2:
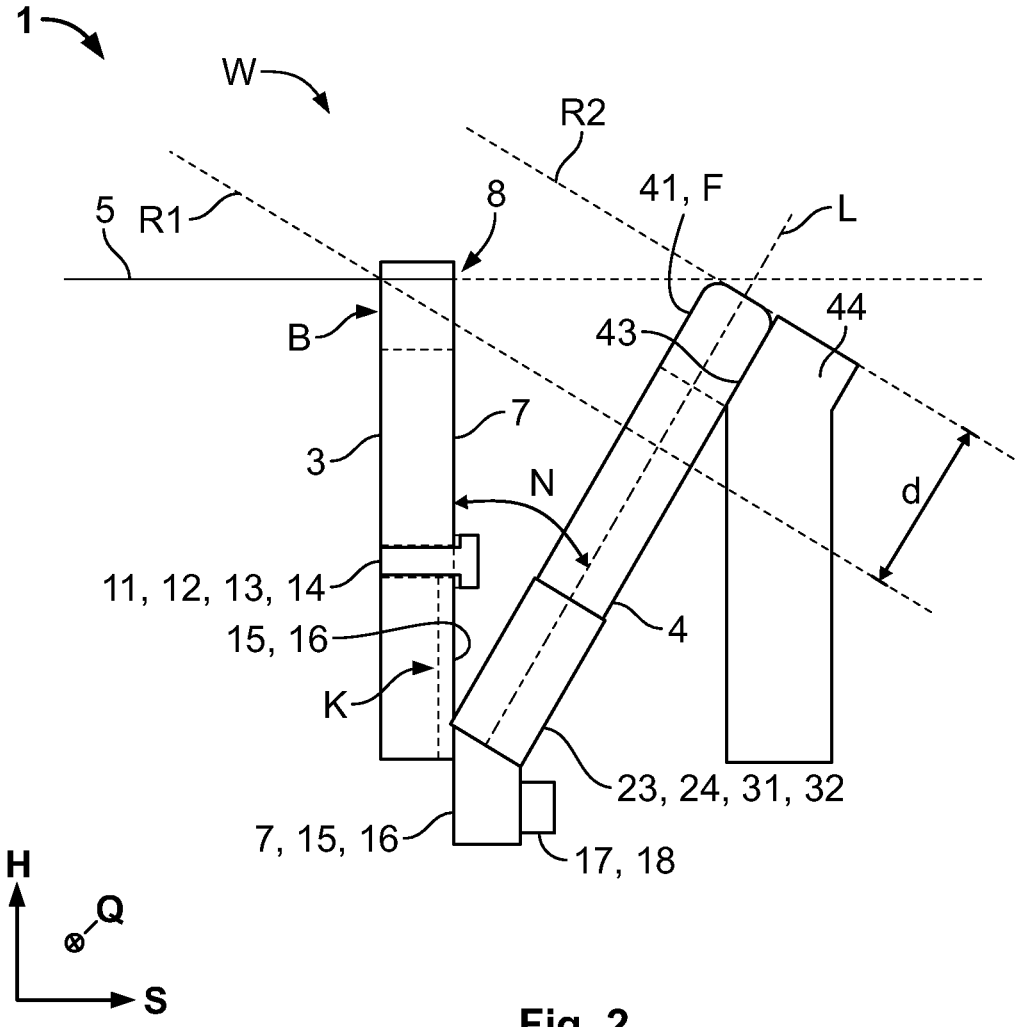
FIG. 2 is a schematic side view of the contact arrangement of the embodiment of FIG. 1.

FIG. 2 illustrates another embodiment, the same reference numerals being used for elements which correspond to the elements of the embodiment of FIG. 1 in terms of function and construction. For reasons of brevity, only the differences with respect to the embodiment of FIG. 1 will be discussed.

The contact arrangement 1 is in this instance illustrated as a schematic side view. In this view, it can be seen that the armature spring 2 forms an angle, the abutment member 5 and the switch member 7 being orientated so as to extend substantially perpendicularly relative to each other. However, the switch member 7 and abutment member 5 may also be oriented relative to each other with an acute or obtuse angle. The armature 3 is orientated substantially parallel to the switch member 7 and secured thereto by means of the connection points 12 to 15 which in this instance are in the form of rivets. In the region of the overtravel springs 16, 17, the armature 3 is constructed with a contact indentation 41 which also allows a deflection of the overtravel springs 16, 17 counter to the switching direction S. The cord plane L which is defined by the cord 4 is illustrated in this side view as a dot-dash line.

The recess 8 in the armature spring 2 or the clearance 9 of the armature 3 delimit a tool channel W which extends perpendicularly relative to the cord plane L and which is indicated by the channel edges R1, R2. In particular the position of the channel edge R2 is not limited by components of the contact arrangement 1. Instead, the diameter d of the tool channel W, in particular between the connection region 6 and the connection region 38, defines the predetermined space for a tool for connecting the rigid member 39 to the fixed connection 42 of the relay which is illustrated in addition to the contact arrangement 1 in this instance.

In this illustration, it can be seen that, owing to the cord 4 which extends in a self-supporting manner at the angle of inclination N relative to the switch member 7 of the armature spring 2, even without the recess 8 or the clearance 9, the tool channel W has a diameter d which is large enough to guide a tool for connecting the connection region 38 to the fixed connection 42 along the tool channel W relative to the rigid member 39 and the fixed connection 42. However, owing to the recess 8 and the clearance 9, the connection tools can be more readily positioned or larger tools can be used. Neither the cord 4 nor the fixed connection 42 protrudes in the vertical direction H substantially beyond the abutment member 5 of the armature spring 2.

The angle of inclination N is in this embodiment approximately 30°; however, it may also be greater or less than 30° and in particular at least 10° and up to 90° or more.

In the following embodiments, it becomes clear that the contact assembly 1 can be assembled in a relay in a simple and at least partially automated manner owing to the self-retaining and inherently stable self-supporting structure of the cord 4, the height of the relay in the vertical direction H not being unnecessarily increased by the cord 4 or the fixed connection 42.

Figure 3:
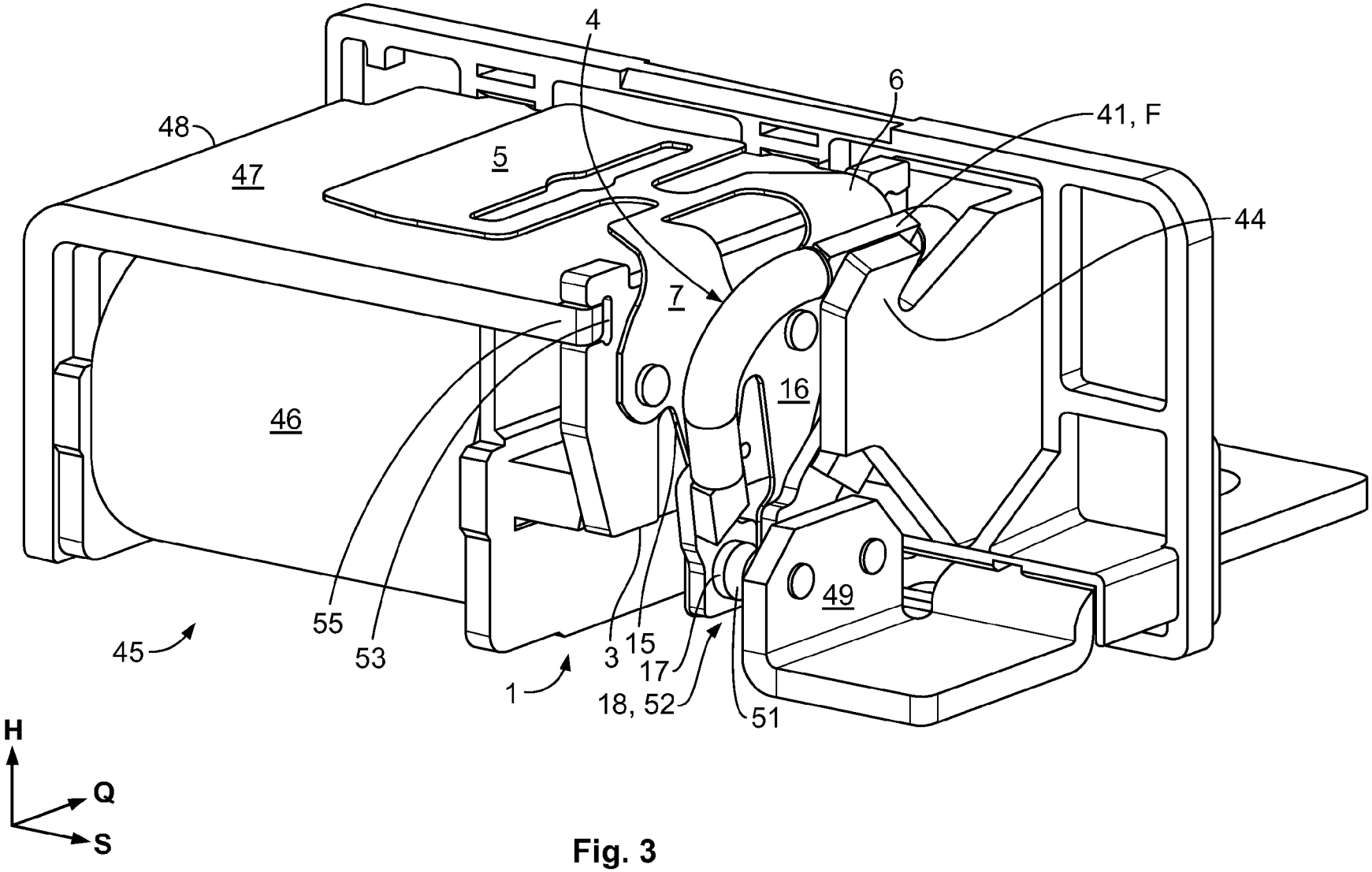
FIG. 3 is a perspective view of a second embodiment of the invention which differs from the previous embodiments in that the contact arrangement is pre-assembled in a relay.

FIG. 3 illustrates a first embodiment of a relay having the contact arrangement 1 according to the invention, the same reference numerals being used for elements which correspond to the elements of the embodiments of FIG. 1 or 2 in terms of function and construction. For reasons of brevity, only the differences with respect to the embodiments of FIGS. 1 and 2 will be discussed.

FIG. 3 illustrates the contact arrangement 1 positioned in a relay 43. The relay 43 comprises an actuator 44 which is constructed as a coil and which converts control signals into movements of the armature 3. The armature 3 transmits these movements to the switch member 7 of the armature spring 2 and in particular to the overtravel springs 16, 17 and the switching contacts 18, 19 which are securely connected thereto. The switching contacts 18, 19 are deflected parallel to the switching direction S when a corresponding control signal is present at the actuator 44.

The abutment member 5 is in resiliently deflected abutment against a stop 45 of an L-shaped yoke 46 and directs the resilient force produced by this deflection via the connection region 6 and the switch member 7 into the armature 3. The switching contacts 18, 19 are in abutment, with the surfaces 20, 21 thereof directed in the switching direction S, against fixed contacts 48, 49 which are retained by means of a fixed contact holder 47 so as to conduct load current. The relay 43 may be configured as an opening or closing member. If the switching contacts 18, 19 each have more than one surface 20, 21, which may extend in and counter to the switching direction S, and if a corresponding number of appropriately orientated fixed contacts 48, 49 are provided in the relay 43, the relay 43 may also be constructed as a changeover relay.

The armature 3 has, in the sides thereof which extend parallel to the vertical direction H, retention grooves 50, 51 which are open in the transverse direction Q. Correspondingly formed retention webs 52, 53 of the yoke 46 engage in the retention grooves 50, 51 and secure the armature 3 against movements in the transverse direction Q and the vertical direction H, respectively.

The connection face 40 of the rigid member 39 is in abutment, via the self-supporting cord 4 which independently retains the alignment thereat against a side of the fixed connection 42 facing the connection region 38. The fixed connection 42 is constructed as a continuation of a fixed connection holder 54, which continuation extends substantially in the vertical direction H and which is inclined in the switching direction S and extends parallel to the cord plane L and the connection face 40 of the connection region 38, respectively. The fixed connection holder 54 extends in the transverse direction Q and is orientated parallel to the vertical direction H. In a bent region 55 which extends parallel to the vertical direction H, the fixed connection holder 54 is illustrated angled counter to the switching direction S.

Figure 4:
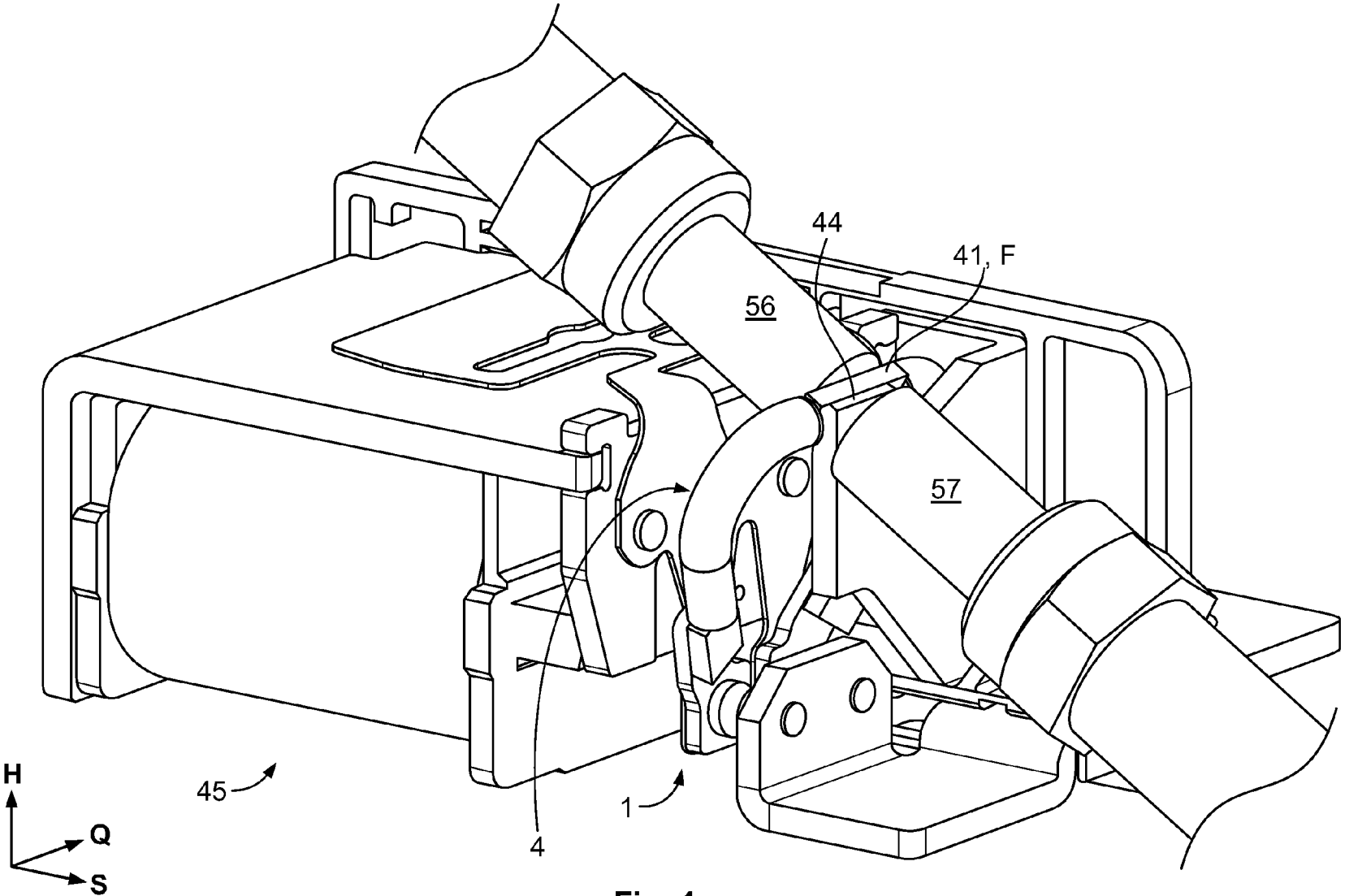
FIG. 4 is a perspective view of a fourth embodiment of the invention which differs from the embodiment of FIG. 3 owing to fixing tools.

FIG. 4 illustrates another embodiment of the relay 43, the same reference numerals being used for elements which correspond to the elements of the embodiments of the previous Figures in terms of function and construction. For reasons of brevity, only the differences with respect to the embodiments of the Figures which have already been described will be discussed.

In FIG. 4, the relay 43 is illustrated with the contact arrangement 1 inserted. The rigid member 39 of the connection region 38 is in pre-positioned abutment against the fixed connection 42 owing to the self-supporting structure of the cord 4. Two connection tools 56, 57 which are guided through the tool channel W press the connection region 38 onto the fixed connection 42, the connection tools 56, 57 acting from opposing directions on the rigid member 39 or the fixed connection 42. The connection tools 56, 57 may, for example, be welding electrodes which weld the rid member 39 to the fixed connection 42.

Since the cord 4 is retained in an inherently stable manner owing to its shape as a self-supporting structure, and the rigid member 39 is consequently in pre-positioned abutment against the fixed connection 42 with no external auxiliary means, the connection tools 56, 57 can connect the connection region 38 and the fixed connection 42 together so as to conduct load current in an at least partially automated manner and, in particular after the relay 43 has been inserted into a welding device, with no manual intervention at all.

The invention claimed is:

1. Contact arrangement for a relay for switching high load currents, comprising:

at least one connection region;

at least one switching contact which can be moved relative to the connection region in a switching direction;

a flexible cord which has a bent shape and which connects the at least one connection region to the at least one switching contact so as to conduct load current;

an armature; and an armature spring which forms an angle and which has at least one abutment member and at least one switch member, the at least one switch member being secured to the armature and the armature being connected to the at least one switching contact so as to transmit movement; wherein the cord is retained in an inherently stable manner because it is formed as a self-supporting structure, and wherein an uninterrupted tool channel extends at both sides of the connection region substantially perpendicularly relative to a connection face of the connection region and comprises a recess formed by the overtravel spring.

2. Contact arrangement according to claim 1, wherein the cord is resiliently pretensioned.

3. Contact arrangement according to claim 1, wherein the cord has two ends and the cord forms an indentation or loop which expands in a direction orientated away from the ends thereof.

4. Contact arrangement according to claim 1, wherein the ends of the cord are connected to the at least one switching contact.

5. Contact arrangement according to claim 1, wherein the at least one connection region is arranged on the cord substantially centrally between the ends.

6. Contact arrangement according to claim 1, wherein connection region extends in a portion of the cord which is at a maximum distance from the at least one switching contact.

7. Contact arrangement according to claim 1, wherein the cord is constructed as a rigid member in the region of the ends thereof and/or in the region of the at least one connection region.

8. Contact arrangement according to claim 1, wherein the contact arrangement has an armature and an armature spring which forms an angle and which has at least one abutment member and at least one switch member, the at least one switch member being secured to the armature and the armature being connected to the at least one switching contact so as to transmit movement.

9. Relay for switching high load currents, characterised by a contact arrangement according to claim 1.

10. Relay according to claim 9, wherein the relay comprises a fixed connection which is securely connected to the connection face of the connection region and which protrudes into the tool channel.

11. Method for assembling a relay of claim 1 wherein the cord is bent and pre-tensioned to produce opposing forces ($F_1$, $F_2$) to form a self-supporting structure.

12. Method according to claim 11, characterised in that the cord is secured in a bent manner counter to a restoring force which it produces, the restoring force shaping the cord in an inherently stable manner.

13. Method according to claim 11, characterised in that when the contact arrangement is positioned in the relay in an operating position, the connection region is automatically pre-positioned in a connection position with respect to the fixed connection by the self-supporting structure of the cord.

* * * * *